United States Patent [19]

Windisch

[11] 4,283,052

[45] Aug. 11, 1981

[54] ELECTRONIC AMUSEMENT APPARATUS AND CIRCUIT

[76] Inventor: Anthony J. Windisch, 3882 Walsh St., St. Louis, Mo. 63166

[21] Appl. No.: 88,290

[22] Filed: Oct. 26, 1979

[51] Int. Cl.[3] ..... A63F 9/00; A63F 5/00

[52] U.S. Cl. ..... 273/85 G; 273/88; 273/94; 273/138 A; 273/237

[58] Field of Search ..... 273/85 G, 138 A, 237, 273/88, 93 R, 94

[56] References Cited

U.S. PATENT DOCUMENTS

| | | | |
|---|---|---|---|
| 669,433 | 5/1901 | Yale | 273/138 A |
| 1,943,685 | 1/1934 | Mayorga | 273/88 |
| 2,118,359 | 5/1938 | Quinn | 273/93 R |
| 2,696,384 | 12/1954 | Roth | 273/88 |
| 3,791,650 | 2/1974 | Dice | 273/138 A |
| 3,871,652 | 3/1975 | Schreier | 273/138 A X |
| 3,902,723 | 9/1975 | Colling et al. | 273/138 A X |
| 4,017,081 | 4/1977 | Windisch | 273/138 A |
| 4,034,988 | 7/1977 | Goldner et al. | 273/138 A |
| 4,060,242 | 11/1977 | Huang et al. | 273/138 A |

*Primary Examiner*—Paul E. Shapiro
*Attorney, Agent, or Firm*—James R. Bell

[57] ABSTRACT

An amusement apparatus is constructed to be hand-held and includes a display of binary indicators on a playing surface. A sequence of a preselected number of pulses actuates the indicators. The number of pulses varies among the indicators until ultimately, one of the indicators remains actuated.

2 Claims, 15 Drawing Figures

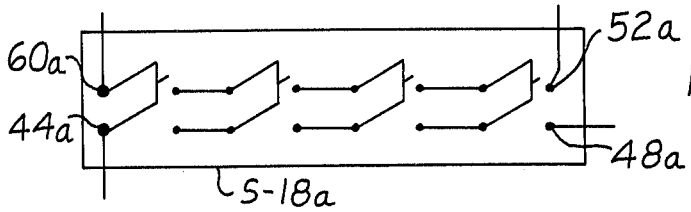
FIG_2_
FIG_3_
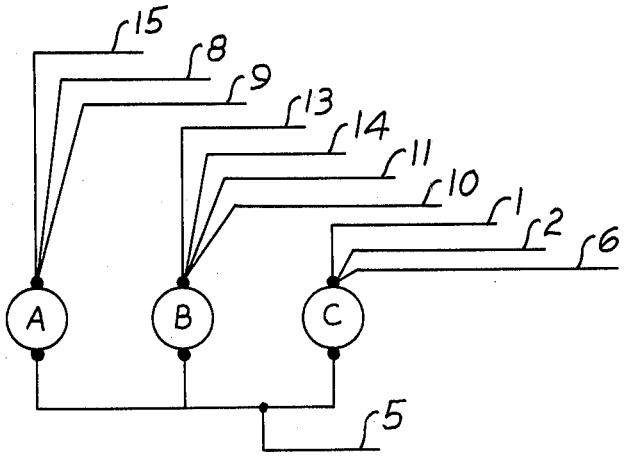
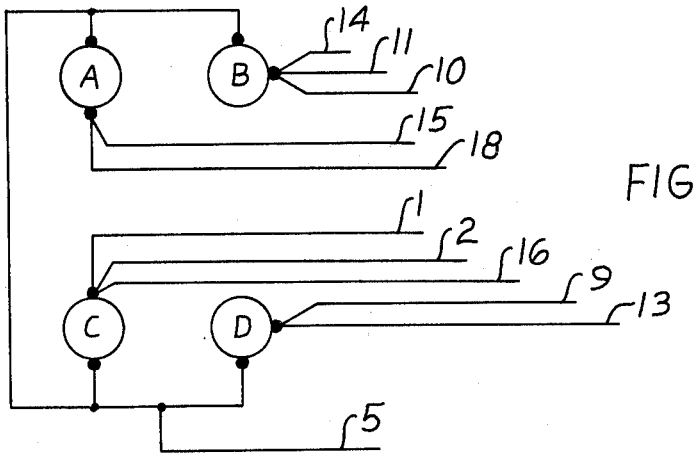
FIG_4_
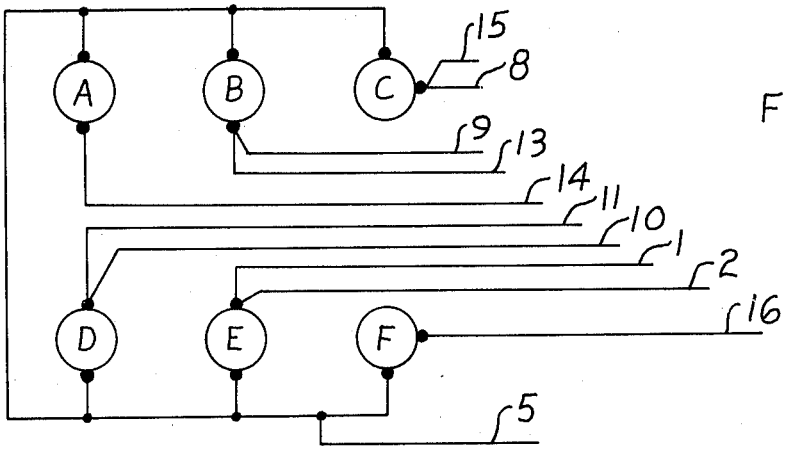
FIG_5_

ELECTRONIC AMUSEMENT APPARATUS AND CIRCUIT

DESCRIPTION

1. Technical Field

This invention relates generally to amusement devices and games and more particularly to electronic or magnetic chance devices.

2. Background Art

In the past, electrically operated random selection devices such as that disclosed in U.S. Pat. No. 3,791,650 to Dice and known random number generators had limited application and were generally restricted to games of chance such as dice, roulette, black jack, or simple spin and move games.

Other random selection devices such as that disclosed in U.S. Pat. No. 4,017,081 to Windisch, which generate random binary indicators, taught assignment of any desired value or game function to each binary indicator accompanied by placement of the binary indicators in preselected patterns to simulate different game effects. The many possible combinations of these variables has increased the number of games that can be applied to the use of a simple binary indicator circuit.

Presently known binary indicator circuit games have not been developed enough to compete with the more complex sophisticated electronic games. The Windisch Patent disclosed an electronic selection device having individual binary output signals with a light emitting diode display. These binary indicators permit assignment of any desired value or game function to each of the binary indicators and also the placement of the indicators randomly or in any desired pattern or sequence on an associated playing surface.

As used in the past, the indicators have each been supplied with a single pulse until each indicator is pulsed one time. Thereafter, each indicator again receives a single pulse. Also, there are no means provided to vary the first and second oscillating signal of the Windisch Patent or to introduce additional player participation.

The foregoing illustrates limitations of the known prior art. Thus, it is apparent that it would be advantageous to provide an alternative to the prior art.

DISCLOSURE OF INVENTION

In one aspect of the present invention, this is accomplished by providing an electronic amusement apparatus and circuit including a plurality of binary indicators displayed on a playing surface and an associated means for electronically pulsing the indicators according to a sequence. The sequence includes a preselected number of pulses for actuating the indicators. The number of pulses varies among the indicators until one of the pulses ultimately causes one of the indicators to remain actuated.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawings.

FIG. 2 is a view illustrating a modified switching device of the invention;

FIGS. 3–5 are partial views illustrating modified binary indicator arrangements of the invention;

BEST MODE FOR CARRYING OUT THE INVENTION

Figure 1:
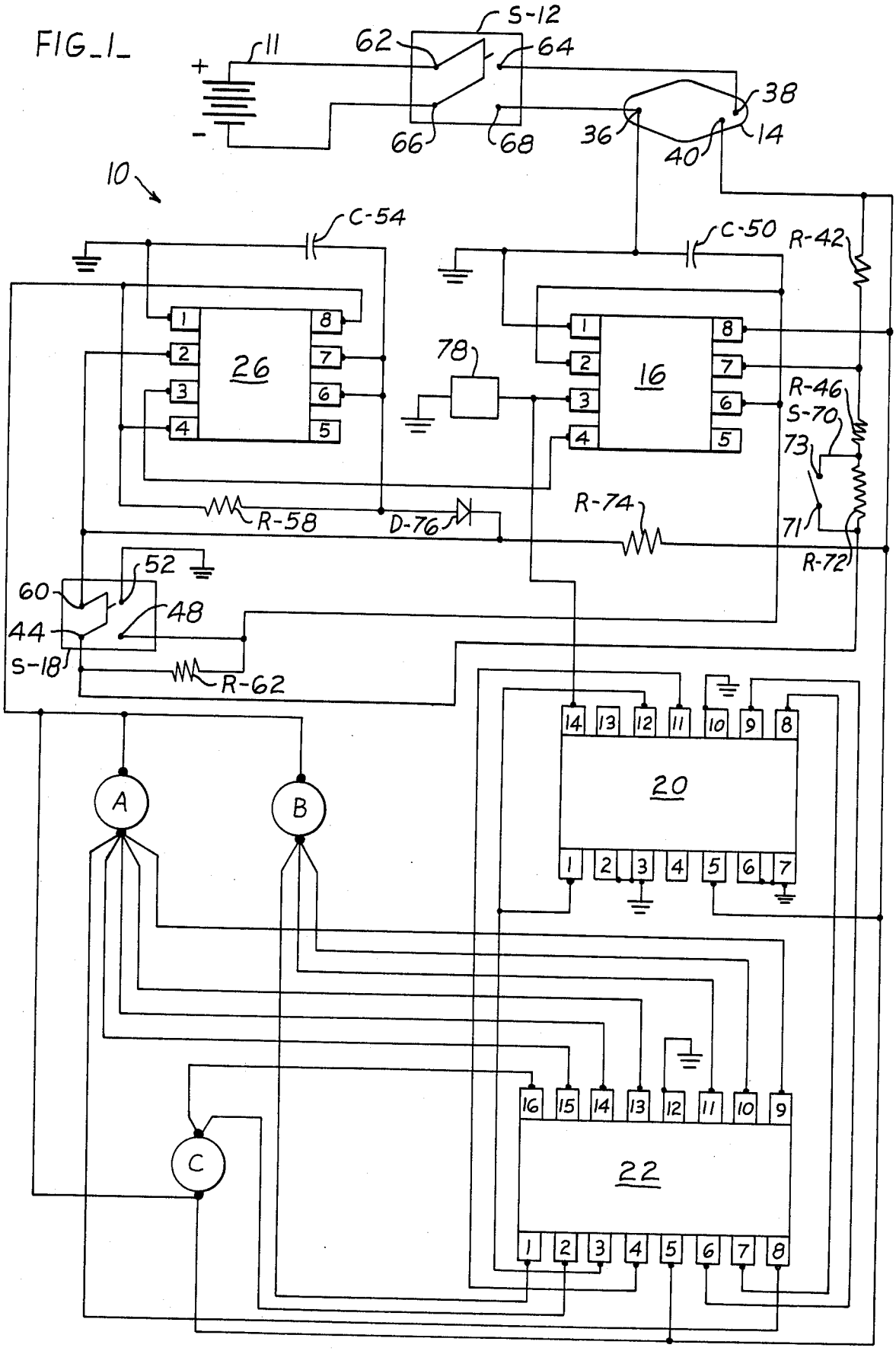
FIG. 1 is a wiring diagram illustrating the circuit of this amusement apparatus.

The circuit generally designated 10 of FIG. 1 illustrates power supply 11 which is preferably a six volt power source which may comprise four 1.5 volt direct current batteries such as commonly available type "D" cells. Power supply 11 is connected by appropriate conductors to power switch S-12, a commercially available double pole single throw type switch, including a circuit open (off) position wherein pins 62,64 and pins 66,68 are not electrically connected, and a circuit closed (on) position wherein these pins are connected. Switch S-12 is illustrated in the circuit open (off) position.

Switch S-12 is connected by appropriate conductors to a voltage regulator 14 at pins 36,38. Pin 36 is connected to ground. Voltage regulator 14 is a commercially available item such as, for example, the product LM-309K voltage regulator, catalogue number 276-1830 sold under the Trademark ARCHER. Such a voltage regulator is a 5 volt regulator fabricated on a single silicon chip. These regulators are provided to employ internal current limiting, thermal shutdown, and safe-area compensation which makes the circuitry essentially blow-out proof. As used in the device of this invention, output at pin 40 is substantially at a control voltage of 5.25 volts.

Of course an appropriate resistor can be used in place of regulator 14 for the purpose of dropping voltage from source 11 to the desired control voltage. However, it should be recognized that use of regulator 14 rather than a resistor is advantageous in that regulator 14 offers protection against circuit overload whereas a resistor would not offer such protection.

Voltage output pin 40 of regulator 14 is connected by an appropriate conductor to pin 8 of commercially available, linear integrated timer circuit 16 such as, for example, the product type 555 Intergrated Circuit Timer catalogue number 276-1723 sold under the Trademark ARCHER. Such a timer circuit is a highly stable controller capable of producing oscillation or accurate time delays. For a stable operation as an oscillator, the free running frequency and the duty cycle are both accurately controlled with two external resistors and one capacitor. Pin 7 of circuit 16 connects to pin 40 of regulator 14 through an appropriate conductor interconnected by resistor R42 a 4.7 k-ohm resistor. Also, pin 7 of circuit 16 connects to pin 44 of a control switch S-18 through an appropriate conductor interconnected by a resistor R72, a 33 k-ohm resistor and resistor R46, a 62 k-ohm resistor. R72 can be bypassed by closing a skill switch S-70. Pin 6 of circuit 16 connects to pin 48 of control switch S-18 and also to pin 2 of circuit 16, both pins 2 and 6 being connected to ground via capacitor C50, a 1 micro-farad capacitor. Pin 4 of circuit 16 connects to pin 3 of a second timer circuit 26, to be discussed later in greater detail. Pin 1 of circuit 16 goes to ground. Pin 8 of circuit 16 goes to 40.

Pin 3 of circuit 16 connects to ground through an optional sound emitting device 78 such as, for example, the product type CALECTRO solid state electronic buzzer catalogue number J4-816. Pin 3 of circuit 16 also connects to pin 14 of commercially available integrated circuit decade counter 26 such as, for example, the product type 7490, catalogue number 276-1808, TTL Integrated Circuit Decade Counter sold under the Trademark ARCHER. Such a decade counter comprises a high-speed, monolithic decade counter having four dual-rank, master-slave flip-flops internally interconnected to provide a divide-by-two and a divide-by-five counter. Gated direct reset lines are provided to inhibit count inputs and return all outputs to a logical "0" or to a binary coded decimal (BCD) count of 9. When used as a BCD decade counter, the binary decimal input, pin 1, must be externally connected to output pin 12. Pin 14 receives the incoming count and a count sequence is obtained in accordance with the table shown below:

| | OUTPUT | | | |
|---|---|---|---|---|
| COUNT | Pin 11 | Pin 8 | Pin 9 | Pin 12 |
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |

In addition to a conventional "0" reset, inputs are provided to reset a BCD count for nine's compliment decimal applications. Input voltage from pin 3 of timer circuit 16 enters counter 20 at pin 14 thereof. Control voltage from pin 40 of regulator 14 is provided at pin 5 of counter 20. Pins 2,3,6,7 and 10 of counter 20 go to ground. Pins 12 and 1 are interconnected. Pin 11 of counter circuit 20 is connected to pin 4 of decoder driver 22, to be discussed later in greater detail. Pin 12 of counter circuit is connected to pin 3 of driver 22. Pins 9 and 8 of counter circuit 20 are connected to pins 6 and 7, respectively, of driver 22.

Integrated circuit BCD-to-decimal decoder/driver 22 is connected to receive control voltage at pin 5 thereof from pin 40 of regulator 14. Decoder/driver circuit 22 is commercially available such as, for example, the product type 7441, catalogue number 276-1804, TTL Integrated Circuit BCD-to-Decimal Decoder/-Driver sold under the Trademark ARCHER. Such decoder/driver integrated circuits incorporate high performance output transistors designed for driving gas filled, cold cathode indicator tubes. The decoder comprises TTL gate circuits which select one of ten output drivers. Inputs from pins 8,9,11 and 12 of counter circuit 20 are connected to be provided at pins 7,6,4 and 3, respectively, of decoder 22. Pin 12 of decoder 12 is connected to ground. Output from pins 1,2,8,9,10,11,13,14,15 and 16 are connected to provide input voltage for a plurality of binary indicators such as light emitting diodes designated A,B and C in FIG. 1.

Diodes A,B,C are connected to receive control voltage from pin 40 of regulator 14 and to receive input pulses from decoder 22 as stated above. As shown in FIG. 1, each pulse will illuminate one of the diodes A,B,C accompanied by a simultaneous sound from sound emitting device 78. Diodes A,B,C are commercially available such as, for example, the product Light Emitting Diode, catalogue number 276-041, sold under the Trademark ARCHER. As illustrated in FIG. 1, a pulsed output from pins of decoder 22 occurs according to the following sequence:

| Pulse No. | Pin No. |
|---|---|
| 1 | 15 |
| 2 | 8 |
| 3 | 9 |
| 4 | 13 |
| 5 | 14 |
| 6 | 11 |
| 7 | 10 |
| 8 | 1 |
| 9 | 2 |
| 0 | 16 |

Timer circuit 26 is connected to timer circuit 16 and to control switch S-18. Timer circuit 26 is the same product as circuit 16, hereinabove described but is connected as shown to provide a time delay to the random selection device. Pin 1 of circuit 26 goes to ground as do pins 6 and 7 via capacitor C-54, a 4.7 micro-farad capacitor. Pin 2 of circuit 26 connects to pin 60 of switch S-18. Pins 6 and 7 of timer 26 are interconnected and are connected to pin 60 of switch S-18 via a diode D76, an IN4148 diode, whereas interconnected pins 4 and 8 are connected to pin 60 of switch S-18 via a resistor R-58, a 1 M-ohm resistor, and by diode D76. Pin 60 of switch S-18 is connected to receive control voltage from pin 40 of regulator 14 through resistor R-74, a 100 k-ohm resistor. Interconnected pins 2 and 6 of timer 16, connected to pin 48 of switch S-18 and pin 7 of timer 16 connected to pin 44 of switch S-18 can be interconnected by resistor R62, a 270 k-ohm resistor when switch S-18 is positioned to open between pins 44 and 48 thereof. Control switch S-18 is preferably a commercially available double pole single throw switch including a "spin" or first position wherein pins 60,52 and 44,48 are interconnected, and a "select" or second position wherein the pins 60,52 and 44,48 are open. As illustrated in FIG. 1, pin 52 is connected to ground. When switch S-18 is closed, diode D76 assists in loading up capacitor C54 thus causing one of the diodes A,B,C to remain illuminated. Thus, the circuit 10 functions as a means for electronically pulsing diodes A,B and C. Circuit 10 is connected to drive a sequence of pulses; each of those pulses illuminating diodes A,B and C. The sequence includes 10 pulses which vary among the diodes. That is, diode A receives pulses 1,2,3,4 and 5; diode B receives pulses 6,7, and 8; and diode C receives pulses 9 and 0.

With power switch S-12 closed or connected in an "on" position, pins 62,64 and 66,68 are interconnected. Control switch S-18 is in a "spin" position interconnecting pins 60,52 and 44,48. Control voltage is provided directly from pin 40 of regulator 14 to pin 8 of first timer circuit 16. Also, power is indirectly provided to pin 7 of timer 16 via resistor R-42 and to pin 6 of timer 16 via resistors R-42, R-46 and R-72 provided skill switch S-70 is "open" with pins 71,73 disconnected. Control voltage also goes to ground via resistor R-74 and across pins 60,52.

Through the internal circuitry of timer 16, current builds for discharge from pin 6 to ground through capacitor C-50 thus triggering shut down of the internal circuitry of timer 16 via pin 2 thereof. Due to the interconnection of pins 60,52 of switch S-18 in the "spin" position, control voltage from pin 3 of timer 26 is provided to pin 4 of timer 16 to reset the circuit after shut-off. The cycle is repeated resulting in a continuous first oscillating signal produced by timer circuit 16. The on-off output of timer 16 is conducted from pin 3 of timer 16 to pin 14 of decade counter 20 resulting in a continuous binary counting of a sequence of ten constant rate pulses numbering 0–9. The pulses may also be received by the optional sound emitting device 78. These pulses are provided (in binary code) from pins 8,9,11 and 12 of counter 20 as input to pins 3,4,6 and 7 of decoder/driver 22 which, upon receiving the input, decodes or interprets the binary coded decimal into ten separate outputs which are fed to diodes A,B and C from pins 1,2,8,9,10,11,13,14,15 and 16 of decoder 22. As illustrated, the sequence of ten pulses varies among the diodes. That is, diode A is connected to pins 15,8,9,13 and 14 of decoder 22 to provide illumination of diode A on pulses 1–5. Diode B is connected to pins 11,10 and 1 to provide illumination of diode B on pulses 6–8. Diode C is connected to pins 2 and 16 to provide illumination of diode C on pulses 9 and 0, thus completing the sequence of ten pulses.

When switch S-18 is placed in a "select" position, pins 60,52 and 44,48 are disconnected. As a result, resistor R-62 is introduced into the circuit to influence timer 16 thus stepping down or slowing the first oscillating signal fed into pin 6 of timer 16 and results in a second oscillating signal providing the sequence of ten constant rate pulses at a rate slower than the first oscillating signal. Placing switch S-18 in the "select" position also connects control voltage from pin 40 of regulator 14 to pin 2 of second timer circuit 26. This introduces circuit 26. Through the internal circuitry of timer 26, current builds for discharge from pin 7 to ground through capacitor C-54 thus, after a time delay, triggers shut-down of the internal circuitry of timer 26. The presence of diode D-76 assists in loading up capacitor C-54 for discharge. Thus, a new reset voltage source from pin 3 of timer 26 is supplied to timer 16. This new reset voltage is turned off when capacitor C-54 discharges and the slower, second oscillating signal is stopped so that one of the ten pulses randomly illuminates one of the diodes A,B or C.

As illustrated in FIG. 1, the so-called skill switch S-70 can be introduced in the circuit 16 so that when switch 70 is closed, connecting pins 71,73, resistor R-72 is bypassed and as a result, both the first and second rates of pulses are increased to a rate faster than their original rate.

FIG. 2 illustrates an alternative switch S-18*a* replacing switch S-18, thus providing a plurality of spin-select switches in series. In this manner, added players can each operate a spin-select switch for disconnecting pins 60*a*,52*a* and 44*a*, 48*a*. With each of the switches closed, any player can open contact between the pins to actuate circuit 10 from a spin mode to a select mode.

FIG. 3 illustrates a possible connection of diodes A,B and C to the output pins 1,2,8,9,10,11,13,14,15 and 16 of decoder/driver 22. For example, pins 15,8 and 9 of decoder/driver 22 can be connected to diode A to provide illumination of diode A on pulses 1,2 and 3. Pins 13,14,11 and 10 can be connected to diode B to provide illumination of diode B on pulses 4,5,6, and 7. Pins 1,2 and 16 can be connected to diode C on pulses 8,9 and 0, thus completing the sequence of 10 pulses.

FIG. 4 illustrates another possible connection of diodes A,B,C and a fourth diode D to the output pins of decoder/driver 22. For example, pins 15 and 8 can be connected to diode A to provide illumination of diode A on pulses 1 and 2. Pins 9 and 13 can be connected to diode D to provide illumination of diode D on pulses 3 and 4. Pins 14,11 and 10 can be connected to diode B to provide illumination od diode B on pulses 5,6 and 7. Pins 1,2 and 16 can be connected to diode C to provide illumination of diode C on pulses 8,9 and 0.

Finally, FIG. 5 illustrates still another possible connection of diodes A,B,C,D and fifth and sixth diodes E and F to the output pins of decoder/driver 22. For example, pins 15 and 8 can be connected to diode C to provide illumination of diode C on pulses 1 and 2. Pins 9 and 13 can be connected to diode B to provide illumination of diode B on pulses 3 and 4. Pin 14 can be connected to diode A to provide illumination of diode A on pulse 5. Pins 11 and 10 can be connected to diode D to provide illumination of diode D on pulses 6 and 7. Pins 1 and 2 can be connected to diode E to provide illumination of diode E on pulses 8 and 9. Pin 16 can be connected to diode F to provide illumination of diode F on pulse 0.

The foregoing is intended to illustrate the versatility of circuit 10 in varying the number of diodes and the number of pulses per diode. Through such variation, placement of a preselected number of diodes having varying pulses per diode, on a playing surface of a game board can give rise to a family of games of seemingly endless variety. Of course, it should be realized that if preferred, a sequence of pulses can comprise less than the ten pulses as above described by merely omitting connection of a pulse producing pin of driver 22 to any one of the diodes.

Depending on the game enviornment desired, a playing surface can be provided to simulate a sporting event playing surface such as baseball, football, soccer, hockey, tennis, Ping Pong, basketball or a non-sporting event playing surface such as tic-tac-toe, a spinning wheel effect, a celestial body of planets and stars, and so on. The desired number of diodes is selected and placed on the playing surface to simulate game action.

Figure 6:
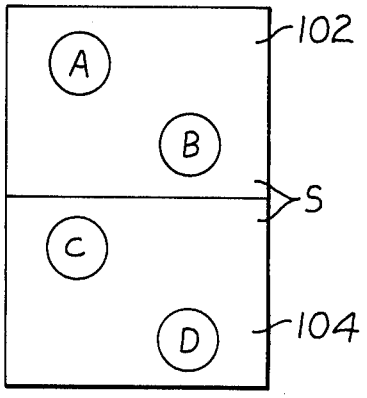
FIGS. 6–14 are diagrammatic views illustrating a few possible game devices usable with the circuit of FIG. 1.

As an example, a game of simulated volleyball, Ping Pong or tennis is illustrated in FIG. 6 which illustrates a playing surface 5, comprising a first half area 102 and a second half area 104. Diodes A,B,C and D can be displayed so that diodes A and B appear in area 102 and diodes C and D appear in area 104. Simulated baselines can be added if desired. Through connection of the appropriate pins of decoder/driver 22 to diodes A,B,C and D, game action can be provided so that diode A receives pulses 1 and 2 in area 102. Then diode D receives pulses 3 and 4 in area 104. Next, diode B receives pulses 5,6 and 7 in area 102. Finally, diode C receives pulses 8,9 and 0 in area 104. Thus, game action appears to move back and forth between areas 102, 104 in that one of the diodes in area 102 is pulsed, then another diode in area 104 is pulsed, and so on, back and forth between the areas 102, 104 until all the diodes are pulsed in a full sequence. The sequence is repeated until actuation of select switch S-18 causes one of the diodes to ultimately remain illuminated.

Figure 7:
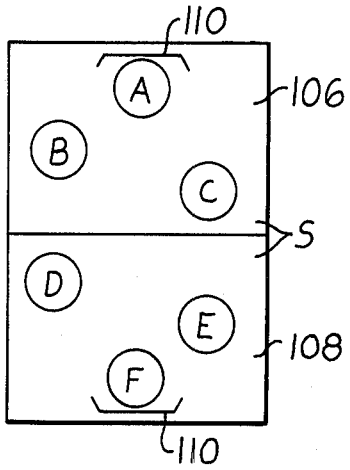
Figure 8:
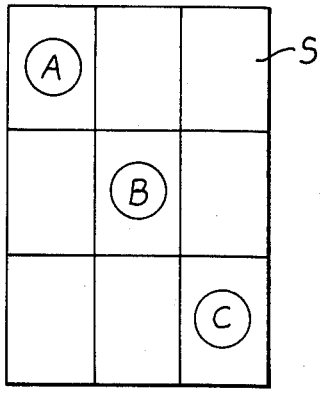
Figure 9:
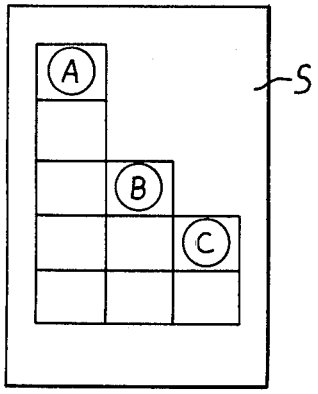
Figure 10:
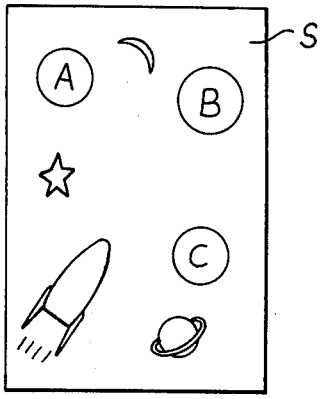
Figure 11:
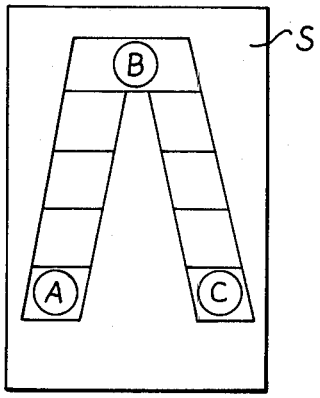

As another example, in FIG. 7 a game of simulated soccer, ice-hockey or basketball is illustrated in FIG. 7 which illustrates a playing surface 5, comprising a first half area 106 and a second half area 108. Diodes A,B,C,D,E and F can be displayed so that diodes A,B and C appear in area 106 and diodes D,E and F appear in area 108. Also, goals 110, baselines, and the like can be added if desired. Through connection of the appropriate pins of decoder/driver 22 to the diodes A,B,C,D,E and F, game action can be provided so that diode C receives pulses 1 and 2 in area 106; diode B receives pulses 3 and 4 in area 106; and diode A receives pulse 5 in area 106. Then, diode D receives pulses 6 and 7 in area 108; diode E receives pulses 8 and 9 in area 108; and diode F receives pulse 0 in area 108. Thus, game action appears to move back and forth between areas 106, 108 in that each diode in area 106 is pulsed then, alternatively, each diode in area 108 is pulsed until all the diodes are pulsed in a full sequence. The sequence is repeated until actuation of select switch S-18 causes one of the diodes to ultimately remain illuminated.

FIGS. 8,9,10 and 11 illustrate a variety of playing surfaces 5, including diodes A,B, and C connected to decoder/driver 22 to be illuminated in alphabetical order so that diode A receives a first plurality of pulses, diode B receives a second plurality of pulses and diode C receives a third plurality of pulses. As a result, the ten pulses from decoder/driver 22 are varied among the diodes. For example, diode A may receive five illuminating pulses, diode B may receive three illuminating pulses and diode C may receive two illuminating pulses until, upon actuation of select switch S-18 to the select mode, one of the pulses will eventually illuminate one of the diodes.

Figure 12:
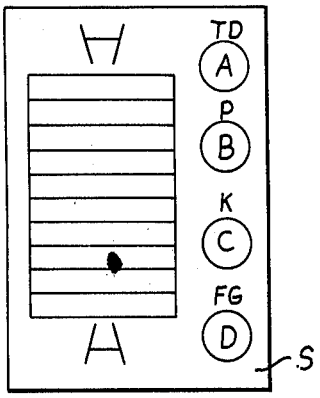
Figure 13:
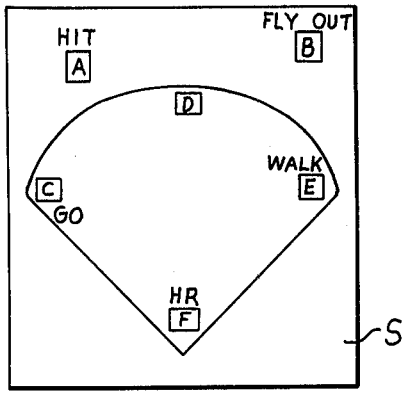
Figure 14:
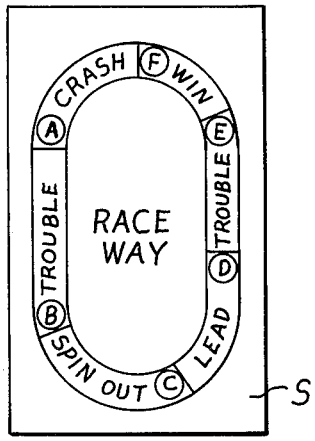

In another example, a playing surface such as that shown in FIGS. 12,13 and 14 illustrate that diodes A–D can be used to indicate a value for a game condition. For example, the diodes as shown in FIG. 12 illustrate that in a simulated football game, diode A can represent a touchdown; diode B, a pass; diode C, a kick; diode D, a field goal, or the like. In FIG. 13, a simulated baseball game can utilize diodes A–F to represent a hit, a home-run, a fly-out, a ground-out, a walk, etc. FIG. 14 illustrates that a simulated auto race can utilize diodes A–F to represent good or bad fortune in an auto race such as spinning-out, crashing, car trouble, etc.

Figure 15:
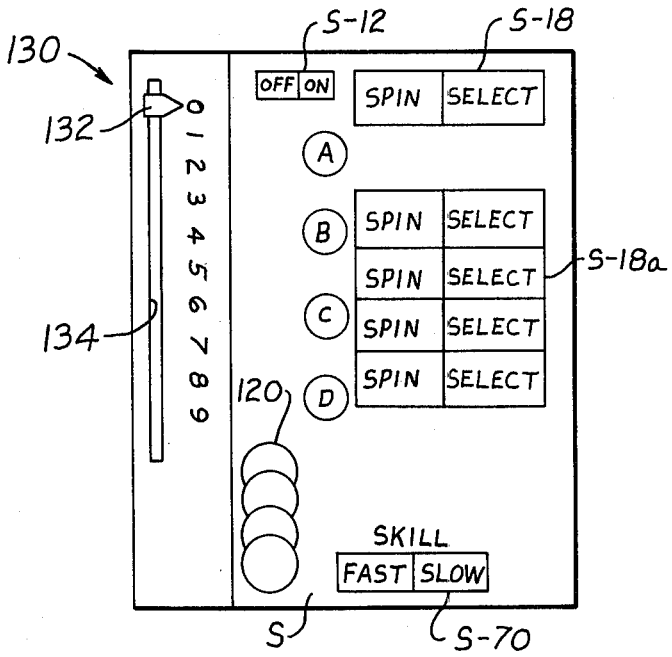
FIG. 15 is a diagrammatic view illustrating supplemental game modifications usable with the circuit of FIG. 1.

In FIG. 15, various game assists are illustrated for use in combination with any or all games. On-off switch is switch S-12 of FIG. 1. A single spin-select switch such as switch S-18 can be used or a plurality of switches S-18*a* can be used as described above. A skill switch such as switch S-70 can be used to regulate a faster or slower spin and select mode as the sequence of pulses becomes familiar to the game participants. Game covers 120 can be used to cover diodes A–D as the game progresses so that certain ones of the diodes can be omitted from further game action. A score recording means 130 can be provided such as a tab 132 movable in a slot 134 in a playing surface 5, for indicating a game score.

The foregoing illustrates that almost any game situation imagined can be created by use of a single economical circuit such as that illustrated in FIG. 1 and described above. Through variation of the playing surface configuration, total number of pulses, number of pulses per diode, and arrangement of the diodes on the playing surface, the game combinations appear to be endless.

In addition to the prior art capabilities, the present invention permits output binary indicators to be used to drive sound, electro-magnets or relays; permits prewiring of a plurality of sequential output pulses to any binary indicator; permits addition of a sound, and/or light emitting diode, and/or other binary indicator actuated by the output power pulse from the oscillator timer circuit; permits use of a skill switch S-70, to increase the rate of the oscillator spin cycle thus making a desired selection more difficult to achieve; and permits the use of a multiple selection control switch 18*a*, to allow simultaneous play by two or more players.

It is the above capabilities in addition to the prior art capabilities in any of several combinations which provides optimum game action and allows design of numerous different games with unique game strategies possible, each different game using the same inexpensive electronic circuit device.

It is anticipitated that further aspects of the present invention can be obtained from the foregoing description and the appended claims.

I claim:

1. An electronic amusement apparatus, comprising:

a playing surface;

a plurality of binary indicators displayed on the playing surface;

means for electronically pulsing the indicators, said means being connected to drive a sequence of pulses for actuating the indicators, said sequence including a preselected number of pulses, said number of pulses varying among said indicators, one of said pulses ultimately causing one of said indicators to remain actuated, the binary indicators are light-emitting diodes, the diodes are displayed in a preselected pattern;

switch means movable between first and second positions, said switch means connected for driving said pulses at a first constant rate when said switch means is in said first position and connected for driving said pulses at a second constant rate, slower than said first rate, when said switch means is in said second position, whereby said one diode ultimately remains illuminated, said playing surface comprises two one-half areas, each of said areas including a plurality of said diodes;

an oscillator timer, and means connected to the oscillator timer for emitting sound in response to each pulse; and said sequence comprises each diode in one of said one-half areas is pulsed and then each diode in the other of said one-half areas is pulsed alternatively.

2. An electronic amusement apparatus, comprising:

a playing surface;

a plurality of binary indicators displayed on the playing surface;

means for electronically pulsing the indicators, said means being connected to drive a sequence of pulses for actuating the indicators, said sequence including a preselected number of pulses, said number of pulses varying among said indicators, one of said pulses ultimately causing one of said indicators to remain actuated, the binary indicators are light-emitting diodes, the diodes are displayed in a preselected pattern;

switch means movable between first and second positions, said switch means connected for driving said pulses at a first constant rate when said switch means is in said first position and connected for driving said pulses at a second constant rate, slower than said first rate, when said switch means is in said second position, whereby said one diode ultimately remains illuminated, said playing surface comprises two one-half areas, each of said areas including a plurality of said diodes;

an oscillator timer, and means connected to the oscillator timer for emitting sound in response to each pulse; and said sequence comprises one of said diodes in one of said one-half areas is pulsed and then one of said diodes in the other of said one-half areas is pulsed alternatively until all of said diodes are pulsed.

* * * * *